US005533681A

United States Patent [19]

Riley

[11] Patent Number: 5,533,681

[45] Date of Patent: Jul. 9, 1996

[54] MEDICAL WASTE GRINDER

[75] Inventor: Wayne C. Riley, Sturtevant, Wis.

[73] Assignee: Emerson Electric Co., Racine, Wis.

[21] Appl. No.: 295,528

[22] Filed: Aug. 24, 1994

Related U.S. Application Data

[63] Continuation-in-part of Ser. No. 64,490, May 19, 1993, Pat. No. 5,340,036.

[51] Int. Cl.[6] ..... B02C 18/40; B02C 18/42

[52] U.S. Cl. ..... 241/56; 241/57; 241/92; 241/606

[58] Field of Search ..... 241/46.013, 60, 241/92, 56, 57, 606, 291, 199.12

[56] References Cited

U.S. PATENT DOCUMENTS

| | | | |
|---|---|---|---|
| 2,012,680 | 8/1935 | Hammes | 241/46.013 X |
| 2,495,983 | 1/1950 | Richards | 241/46.013 |
| 2,682,376 | 6/1954 | Frank | 241/46.013 |
| 2,801,803 | 8/1957 | Borman | 241/46.013 X |
| 2,870,970 | 1/1959 | Williamson | 241/46.013 |
| 5,340,036 | 8/1994 | Riley | 241/56 |
| 5,356,083 | 10/1994 | Wettlaufer | 241/92 |

*Primary Examiner*—John Husar
*Attorney, Agent, or Firm*—Ryan, Maki, Mann & Hohenfeldt

[57] ABSTRACT

A grinder for dry waste materials such as rubber gloves has a vertically-oriented, cylindrically-shaped housing with an opening at its upper end for receiving materials to be comminuted. The housing is divided into upper and lower chambers by means of a rotatable, disk-shaped shredder element. The shredder element has a pair of parallel upwardly-extending impeller blades disposed on its upper surface on opposite sides of its center of rotation which define a channel across the diameter of the shredder element.

7 Claims, 2 Drawing Sheets

MEDICAL WASTE GRINDER

This application is a continuation-in-part of application Ser. No. 064,490 filed May 19, 1993, now U.S. Pat. No. 5,340,036.

FIELD OF THE INVENTION

This invention relates to apparatus for grinding waste materials. More specifically, the invention relates to waste grinders for specifically adapted to grind medical waste such as rubber gloves.

BACKGROUND ART

Food waste disposers in sinks and other types of waste grinding devices are commonly used with a supply of flushing water that transports the ground material through a drainage pipe into a waste disposal system. Because of clogging problems, such disposers have generally not been operated without water. However, many wastes can more efficiently be recovered, recycled, or disposed of if they are maintained in a dry state. Medical wastes such as rubber gloves are difficult to grind in existing equipment because of the tendency for such materials to clog, wedge and jam the disposer. Such materials tend to orient themselves transversely to the blades and are thus not readily disposed of. A need has thus existed for devices that are capable of efficiently grinding wastes such as thin-sectioned rubber materials.

SUMMARY OF THE INVENTION

The present invention has as its principal object the provision of a dry waste grinder adapted to grind or shred thin sectioned rubbery materials such as rubber gloves. In accordance with one aspect of the invention, such materials can be ground up in a dry state and retained in such a state for disposal, for example, by burial in a land fill.

In accordance with another aspect of the invention, other waste materials such as plastics, sticks and needles can be ground into a finely comminuted, or pulverized, material that can safely be disposed of while reducing the hazards usually associated with the disposal of such materials.

In accordance with an important aspect of the invention, a rotating shredder element is provided with shredder/impeller components shaped for optimum handling of the particular materials to be disposed of. The rotating shredder element works in combination with stationary diverter blades mounted around the rotating component in a stationary housing. The diverter blades may be angled or stepped downwardly so as to form cutting surfaces against which the disposed materials are impelled and to transfer the centrifugal force imparted to the material by the rotating element into a downward force that moves the material through the periphery of the rotatable elements to the lower part of the housing or back onto the rotating, cutting elements.

In accordance with a yet further aspect of the invention, the rotating component is provided with two parallel upstanding blades across the full length of the diameter of the rotatable shredder component. Such blades have been found, in accordance with the invention, to provide a dual cutting action as the disposer rotates. The placement of the blades across the full diameter of the shredder has been found to prevent material from wedging crosswise in the shredder chamber and thus causing jamming. Further, material has been found to spill over the first blade impacted by the waste to thence be blown by centrifugal force down the channel formed by the two blades into the stationary cutting blades on the stationary inner wall of the disposer housing.

In a yet further related aspect of the invention, the ends of the parallel blades are angled upwardly and inwardly so that during grinding any particle posing a potential jamming problem at the end of the blade is ejected along the angled surface back into the grind chamber.

In accordance with a further aspect of the invention the stationary blade components are provided with stepped surfaces which form sharp cutting teeth. In accordance with a still further related aspect, the optimum grinding speed and particle size of the comminuted material be controlled by design of the angle of the blade ends, the height of the blades and the number and shape of the steps in the stationary blades.

Briefly summarized, the invention provides a grinder for dry waste materials that includes a vertically-oriented, cylindrically-shaped housing having an opening at its upper end for receiving materials to be ground or comminuted. The housing is divided into upper and lower chambers by means of a rotatable, disk-shaped shredder element. The shredder element has a pair of parallel upwardly-extending impeller blades disposed on its upper surface on opposite sides of its center of rotation which define a channel across the diameter of the shredder element. The impeller blades thrust the waste materials against stationary blades disposed around the upper housing in alignment with the impeller blades.

The invention will further be explained in the following detailed description and accompanying drawings wherein:

DETAILED DESCRIPTION

Referring specifically to the drawings, there is shown a grinder generally indicated by numeral 10. Grinder 10 can be mounted in conventional fashion in a sink opening 12. Grinder 10 includes an upper throat portion 14 for receiving materials to be ground as they are discharged through the opening in sink 12.

Figure 4:
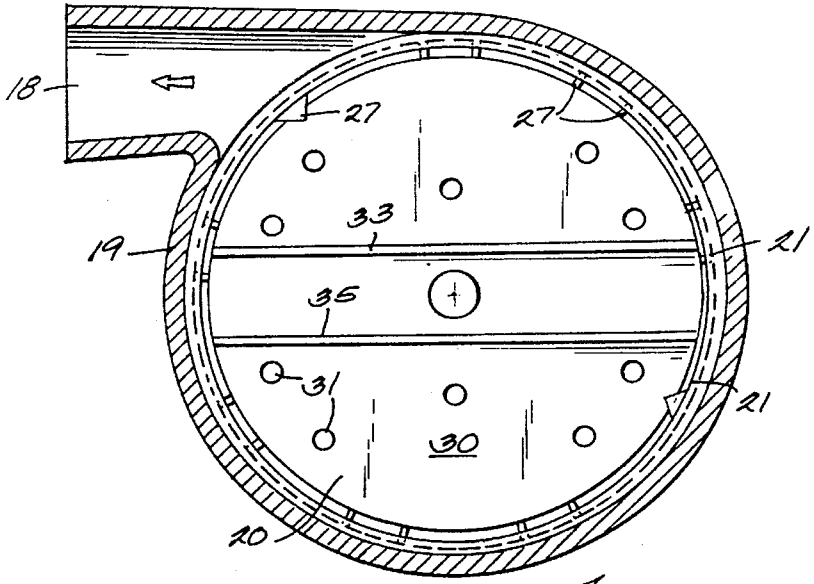

Grinder 10 includes an upper grinding section 16. A discharge opening 18 of a tangential shape as seen in FIG. 4 is provided in a lower housing 19 from which materials are discharged after comminution.

Figure 1:
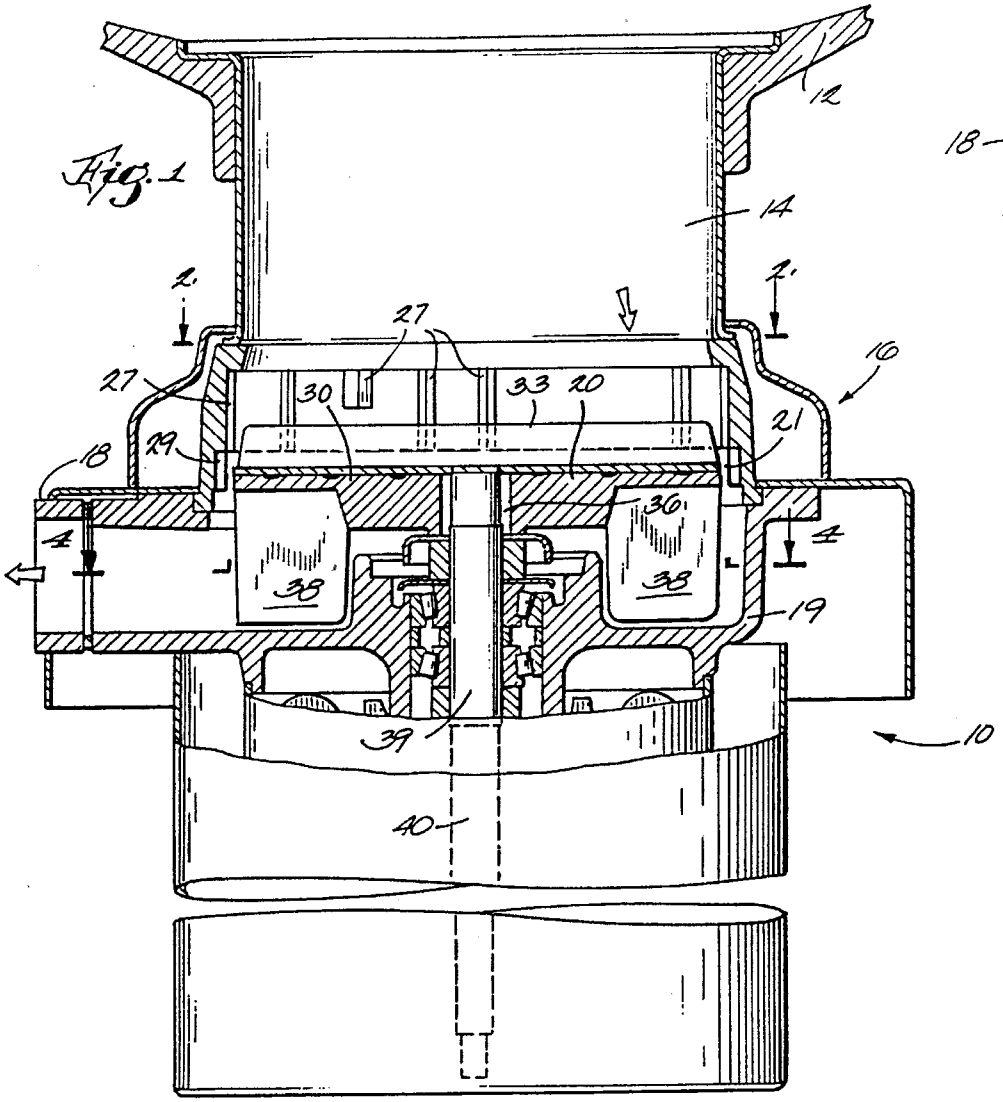
FIG. 1 is a fragmentary side elevational view of a grinder in accordance with the present invention with parts broken away in the cross-section and with other parts shown by phantom lines for purposes of illustration.
Figure 2:
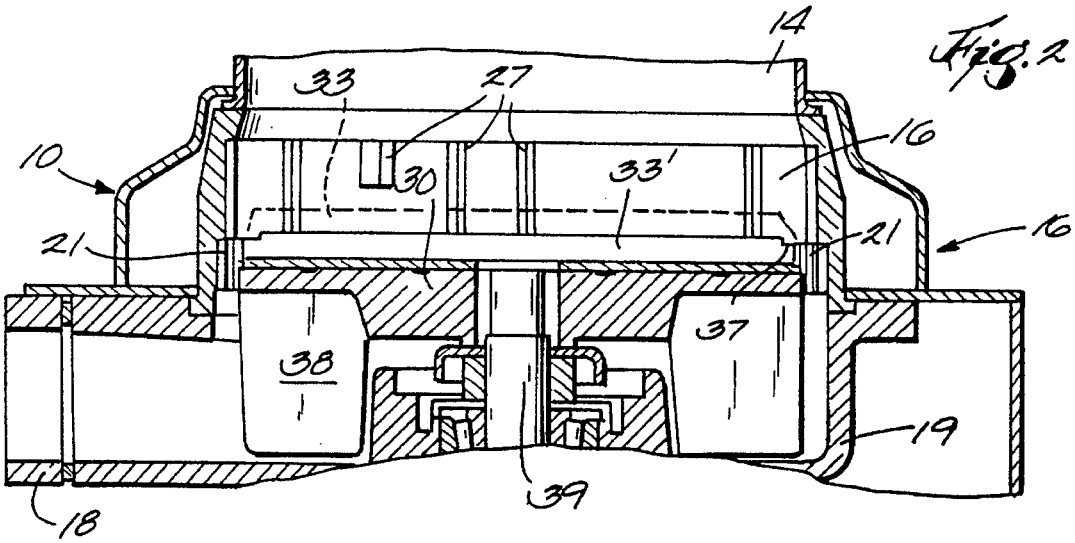
FIG. 2 is a side elevational fragmentary cross-sectional view of a grinder in accordance with a further embodiment of the invention.
Figure 3:
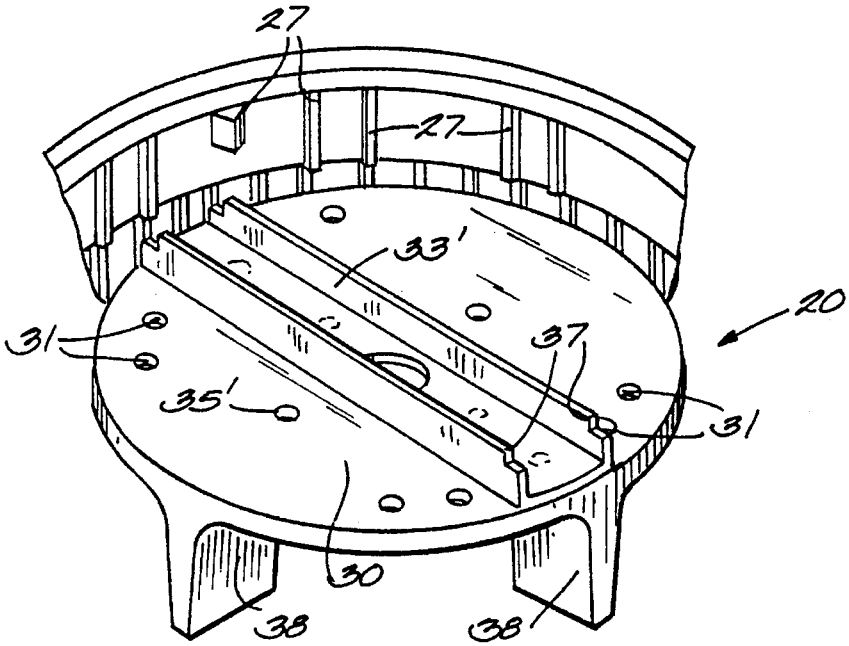
FIG. 3 is a perspective view of a rotational shredder component of a grinder of FIG. 2, shown together with a fragmentary stationary component, and, FIG. 4 is a cross-sectional view taken along line 4—4 of FIG. 1, showing both the shredder component and the lower housing.

A rotatable shredder component 20 divides the grinding section 16 of the grinder from the discharge section, located in lower housing 19. A gap 21 between the upper and lower housings allows material to fall from the grinding chamber 16 into the lower housing 19. Surrounding the grinding chamber 16 is a cylindrical enclosure 26 that is provided on its inner surfaces with spaced blades 27. Blades 27 are provided with sharply cornered angled steps 29 so that materials thrown against them by centrifugal forces of the rotating component 20 are cut and moved by downward forces that impel those materials which have been reduced to a small enough particle size through gap 21 into lower chamber 19. A preferred form of rotatable component is shown in FIG. 3 and indicated generally by numeral 20. Impeller component 20 includes a flat plate portion 30 that may be provided with circular openings 31 around its perimeter. Extending upwardly from plate portion 30 are parallel impeller blades 33 and 35 (or 33' and 35') which may be formed from a single piece of U-shaped metal channel as illustrated. These blades may be provided with end shapes as required in order to cause particles of differing sizes or densities to be impelled by centrifugal forces as the impeller component 20 is rotated and thus to prevent jamming. These ends are preferably angled upwardly and inwardly (FIGS. 1 and 4) and/or provided with steps 37 (blades 33' and 35' in FIGS. 2 and 3) so that materials are readily expelled, thus preventing jamming. A cylindrical central opening 36 is provided for mounting of the rotatable element in the housing on a shaft 39. Holes 31 provide a means for additional air, as well as finely divided particles, to enter the lower chamber and eventually out the discharge opening 18. In order to provide a means to expel the ground particles from the lower housing, the rotatable component 20 is provided with spaced paddle elements 38 that sweep the majority of the cross-sectional area of housing 19 as component 20 is rotated. Shaft 39 is connected to a spindle 40 that is rotationally driven by an electric motor (not shown) in accordance with conventional practice.

A shredder element 20 of the configuration shown in FIG. 3 has been found to work well with plastic or elastomeric waste materials, such as medical wastes, for example, rubber gloves. Such materials can be comminuted and collected for burial or other disposal. A sewer drain line, which might become plugged by such materials, is not required, and the waste material is not contaminated with water.

Paddles or impeller blades 38 at the bottom of the rotating shredder element serve to expel materials from the lower chamber out through opening 18 and also act as a blower. The rotating paddles are capable of moving a large amount of air out of discharge 18 and, thus, draw air through inlet portion 14 of the grinder. The resulting negative air pressure at the inlet helps in drawing fumes and dust into and through the disposer. This provides a safer environment for the operator of the grinding equipment if odorous or hazardous materials are being ground. Such action is particularly important in the case of light-weight materials of a type which could form a dust that would tend to float upward out of the inlet when the grinder is turned on.

Blades 27 can be made out of differing materials depending on the type of use that the grinder is intended for, for example, stainless steel, carbon steel, and cast tool steel with sharpened edges. The size and shape of gap 21, height of blades 33 and 35 and the angle of their ends together with the number and shape of steps in blades 27 control the grinding performance such as speed of grind and particle size of comminuted material. In accordance with a preferred embodiment a combination of blunt, stepped blades 27 and triangularly shaped blades 27 is used.

While specific embodiments of the invention have been shown for purposes of illustration, it will be understood that the scope of the invention is limited only by the following claims.

What is claimed is:

1. A grinder for dry waste materials comprising:

a vertically-oriented, cylindrically-shaped housing having an opening at its upper end for receiving materials to be comminuted, said housing being divided into upper and lower chambers by means of a rotatable, disk-shaped shredder element, said shredder element having a pair of parallel upwardly-extending impeller blades each extending across the width of its upper surface to define an unobstructed channel across the diameter of said element, stationary blades uniformly spaced around the inner perimeter of said upper portion of said housing, said lower housing having a discharge outlet for discharge therefrom of comminuted materials, said shredder element having downwardly extending blades on its lower surface, said blades having an area adapted to sweep said lower housing and expel comminuted materials therefrom outwardly through said discharge opening, said shredder element being connected by a central shaft to a means to rotate said element whereby said grinder is effective in comminuting solid dry waste materials and expelling them through said discharge opening in the absence of a flushing liquid.

2. A grinder according to claim 1 wherein the ends of said impeller blades are upwardly and inwardly tapered.

3. A grinder according to claim 1 wherein said upwardly-extending impeller blades are spaced on opposite sides of the axis of rotation of the shredder element.

4. A grinder according to claim 1 wherein the blades on the bottom of said rotatable shredder element occupy a sufficient portion of the cross-section of said lower housing so that upon rotation they act as a blower capable of moving air out of the discharge opening and drawing air down through the inlet into the disposer.

5. A grinder according to claim 1 wherein the stationary blades are provided with sharp-cornered stepped cutting edges around the circumference of the housing.

6. A grinder according to claim 5 wherein said blade extends outwardly and overhang the edge of said flat area.

7. A grinder for dry waste materials comprising:

a vertically-oriented, cylindrically-shaped housing having an opening at its upper end for receiving materials to be comminuted, said housing being divided into upper and lower chambers by means of a rotatable, disk-shaped shredder element, said shredder element having a pair of parallel upwardly-extending impeller blades disposed on its upper surface on opposite sides of its center of rotation and defining a channel across the diameter of the shredder element, the outer perimeter of said shredder element being separated from the inner wall of said housing sufficiently to provide a gap through which comminuted materials can drop into said lower housing, diverter blades uniformly spaced around the inner perimeter of said upper portion of said housing, said lower housing having a closed bottom and a tangentially-oriented discharge outlet for discharge therefrom of comminuted materials, said shredder element having downwardly extending blades on its lower surface, said blades having an area adapted to sweep said lower housing and expel comminuted materials therefrom outwardly through said tangential opening, said shredder element being connected by a central shaft to a means to rotate said element.

* * * * *